US008420589B2

(12) United States Patent
Kang et al.

(10) Patent No.: US 8,420,589 B2
(45) Date of Patent: Apr. 16, 2013

(54) COMPOSITION FOR TEXTILE SOFTENER HAVING LOW TEMPERATURE ACTIVITY AND TEXTILE SOFTENER SHEET COMPRISING THE SAME

(75) Inventors: Joo-Young Kang, Daejeon (KR); Sang-Woon Kwak, Daejeon (KR)

(73) Assignee: LG Household & Health Care Ltd, Seoul (KR)

( * ) Notice: Subject to any disclaimer, the term of this patent is extended or adjusted under 35 U.S.C. 154(b) by 0 days.

(21) Appl. No.: 13/585,153

(22) Filed: Aug. 14, 2012

(65) Prior Publication Data

US 2012/0309668 A1 Dec. 6, 2012

Related U.S. Application Data

(63) Continuation of application No. 12/532,428, filed as application No. PCT/KR2007/003494 on Jul. 19, 2007, now abandoned.

(30) Foreign Application Priority Data

Mar. 22, 2007 (KR) ..... 10-2007-0028293

(51) Int. Cl.
*C11D 17/00* (2006.01)

(52) U.S. Cl.
USPC ..... 510/521

(58) Field of Classification Search ..... 510/521
See application file for complete search history.

(56) References Cited

U.S. PATENT DOCUMENTS

| | | | | |
|---|---|---|---|---|
| 3,861,870 | A | 1/1975 | Edwards et al. | |
| 4,113,630 | A | 9/1978 | Hagner et al. | |
| 4,898,680 | A | 2/1990 | Clauss et al. | |
| 5,080,810 | A * | 1/1992 | Smith et al. | 510/520 |
| 5,525,245 | A | 6/1996 | Grandmaire et al. | |
| 6,787,510 | B2 | 9/2004 | Santos et al. | |
| 2003/0199417 | A1 | 10/2003 | Fry et al. | |
| 2004/0167057 | A1 | 8/2004 | Pereira et al. | |
| 2005/0288198 | A1 | 12/2005 | Pereira et al. | |
| 2006/0128601 | A1 * | 6/2006 | Pereira et al. | 510/504 |
| 2008/0051309 | A1 | 2/2008 | Lin et al. | |
| 2009/0144913 | A1 * | 6/2009 | Yu et al. | 8/137 |

FOREIGN PATENT DOCUMENTS

| | | | |
|---|---|---|---|
| DE | 4135115 | A1 | 4/1993 |
| DE | 10116491 | A1 | 10/2002 |
| EP | 0293953 | A2 | 12/1988 |
| EP | 0957158 | A1 | 11/1999 |
| EP | 1048722 | A1 | 11/2000 |
| JP | 64-052878 | A | 2/1989 |
| JP | 02-228398 | A | 9/1990 |
| JP | 08-212950 | A | 8/1996 |
| JP | 11-081138 | A | 3/1999 |
| JP | 2005-187974 | A | 7/2005 |
| JP | 2006-138063 | A | 6/2006 |
| KR | 10-1996-0023006 | A | 7/1996 |
| KR | 10-2005-0041001 | A | 5/2005 |
| WO | 2005/063959 | A1 | 7/2005 |
| WO | 2006/027055 | A1 | 3/2006 |

OTHER PUBLICATIONS

European Patent Office, Search Report issued in corresponding EP Application No. 07768820.8, dated Sep. 20, 2010.

Friedli et al., "Upgrading Triethanolamine Esterquat Performance to New Levels," 2002, Journal of Surfactants and Detergents, vol. 5, No. 3, pp. 211-216.

Chinese Patent Office, Office Action issued in corresponding Chinese Application No. 200780052284.7, dated Oct. 13, 2010.

Japanese Patent Office, Office Action issued in Japanese Patent Application No. 2009-554432 dated Sep. 13, 2011.

* cited by examiner

*Primary Examiner* — John Hardee
(74) *Attorney, Agent, or Firm* — Sughrue Mion, PLLC

(57) ABSTRACT

Disclosed is a composition for textile softener containing a cationic surfactant, the ratio of which C7-C21 alkyl substituents analyzed by HLPC (high pressure liquid chromatography) or GC (gas chromatography) is 0.6 or more, as an effective ingredient, a sheet for textile softener including the same, and method of softening a textile using the sheet. Since the composition for textile softener has excellent dissolving and dispersing effect even in low temperature water, the sheet containing this composition is used at a rinse time during washing procedures to represent excellent anti-static effect and textile softening effect to textiles and clothes.

8 Claims, No Drawings

COMPOSITION FOR TEXTILE SOFTENER HAVING LOW TEMPERATURE ACTIVITY AND TEXTILE SOFTENER SHEET COMPRISING THE SAME

CROSS-REFERENCE TO RELATED APPLICATIONS

This application is a continuation of U.S. Ser. No. 12/532,428 filed on Sep. 22, 2009 now abandoned, which is a national stage application under 35 U.S.C. §371 of PCT/KR2007/003494 filed Jul. 19, 2007, which claims priority from Korean Patent Application No. 10-2007-0028293 filed Mar. 22, 2007; all of which are incorporated herein by reference.

TECHNICAL FIELD

The present invention relates to a composition for textile softener having low temperature activity and a sheet for textile softener comprising the same. More specifically, the present invention relates to a composition for textile softener comprising one or more cationic surfactants represented by the specific formulas as an effective ingredient, wherein said cationic surfactants comply with the specific mathematical formulas, and a sheet for textile softener prepared by applying or supporting the composition on a substrate sheet.

BACKGROUND ART

Generally, to give static protection and softness to clothes, most homes use textile softeners on laundering them, and their use amount has been on the rise. Recently, home textile softeners with various functions besides aspects such as static protection and softness as the basic functions of textile softeners have been sold as the standard of living is improved.

However, most of home textile softeners on the market have liquid phase types, and packaging containers have been sold in a volume of as much as 1 to 5 Kg. Therefore, housewives purchasing and using these softeners are so heavy and inconvenient to handle them. In addition, U.S. Pat. Nos. 5,094,761, 5,102,564, 5,234,610, 5,348,667, 5,470,492, 5,476,599, 5,552,378, 5,883,069, 5,929,026, 6,133,226, 6,297,210, 6,352,969, and 6,436,896, and the like, disclose sheet typed textile softeners used for dryers rather than liquid typed textile softeners used at a rinse time of general washing machines. Said sheet typed textile softeners are so light to be simply used. However, effective ingredients on the sheet are not dissolved and dispersed in low temperature water for washing. Therefore, there is a disadvantage that efficiency shows only at high temperature in driers.

SUMMARY OF THE INVENTION

The present invention is intended to solve conventional problems above. One object of the present invention is to provide a composition for textile softener being easy to be applied and supported on a sheet and having excellent solubility/dispersibility in low temperature water.

The other object of the present invention is to provide a sheet for textile softener being able to be used at a rinse time in washing procedures of general washers by the same method as that of a liquid typed textile softener and having easiness of use which is an advantage of sheet typed textile softener used for dryers.

The present composition for textile softener is characterized by comprising one or more cationic surfactants represented by Formula 1, 2 or 3 below, wherein the cationic surfactant complies with Mathematical Formula 1 below.

Formula 1

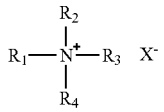

Formula 2

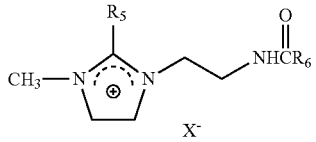

Formula 3

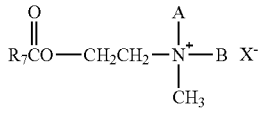

$$Q/T \geqq 0.6$$ Mathematical Formula 1 wherein, $R_1$, $R_2$, $R_5$, $R_6$ and $R_7$ each are a straight or branched, $C_7$-$C_{21}$ alkyl group, $C_7$-$C_{21}$ alkenyl group or $C_7$-$C_{21}$ alkynyl group, $R_3$ and $R_4$ each are a $C_1$-$C_4$ alkyl group, A is a $C_1$-$C_4$ alkyl group, $(CH_2)_nOH$ or $(CH_2)_mOCOR_8$, B is $(CH_2)_nOH$ or $(CH_2)_mOCOR_9$, where, n and m each are an integer of 1 to 4, $R_8$ and $R_9$ each are a straight or branched, $C_7$-$C_{21}$ alkyl group, $C_7$-$C_{21}$ alkenyl group or $C_7$-$C_{21}$ alkynyl group, X is halogen or a $C_1$-$C_4$ alkyl sulfate, preferably F, Cl, I, Br, $CH_3SO_4$ or $CH_3CH_2SO_4$, T is a total area of peaks for the $C_7$-$C_{21}$ alkyl group, $C_7$-$C_{21}$ alkenyl group and $C_7$-$C_{21}$ alkynyl group in the $R_1$, $R_2$, $R_5$, $R_6$, $R_7$, A and B above, detected by HPLC (high pressure liquid chromatography) or GC (gas chromatography), and Q is a total area of peaks for the saturated hydrocarbons, that is the $C_7$-$C_{21}$ alkyl group in the $R_1$, $R_2$, $R_5$, $R_6$, $R_7$, A and B above, detected by HPLC (high pressure liquid chromatography) or GC (gas chromatography).

The cationic surfactants according to the present invention have a saturated hydrocarbon ($C_7$-$C_{21}$ alkyl substituent) ratio of 0.6 or more. When a sheet for textile softener, on which a composition for textile softener comprising said cationic surfactants is applied or supported, is used on rinsing in washing procedures, all effective ingredients are dissolved or dispersed in low temperature water.

The ratio of said Mathematical Formula 1 is preferably 0.6 to 0.9, more preferably 0.7 to 0.9. If the ratio is less than 0.6, the cationic surfactants are not so firmly applied and supported on a sheet to cause a problem that the surfactants are easily seceded from the sheet.

In addition, it is preferred that the cationic surfactant according to the present invention further complies with Mathematical Formula 2 below.

$$P/T \geqq 0.9$$ Mathematical Formula 2 wherein,

P is a total area of peaks for the $C_{12}$-$C_{18}$ alkyl group, $C_{12}$-$C_{18}$ alkenyl group and $C_{12}$-$C_{18}$ alkynyl group in the $R_1$, $R_2$, $R_5$, $R_6$, $R_7$, A and B above, detected by HPLC (high pressure liquid chromatography) or GC (gas chromatography), and T is as defined above.

Said cationic surfactant has a long-chain substituent ($C_{12}$-$C_{18}$ alkyl group, $C_{12}$-$C_{18}$ alkenyl group and $C_{12}$-$C_{18}$ alkynyl group) ratio in the $R_1$, $R_2$, $R_5$, $R_6$, $R_7$, A and B above, detected by HPLC (high pressure liquid chromatography) or GC (gas chromatography), of 0.9 or more, and is easy to be applied and supported on a sheet by Van der Waals' force. When the composition for textile softener comprising said cationic surfactants is applied or supported on a sheet for textile softener, the effective ingredient comprising the cationic surfactant is not easily separated from the sheet, before the sheet is dissolved in water.

In addition, it is preferred that the cationic surfactant according to the present invention further complies with Mathematical Formula 3 below.

$$0.6 \leqq (Q_1/T_1)*X+(Q_2/T_2)*Y+(Q_3/T_3)*Z \leqq 0.9 \quad \text{Mathematical Formula 3}$$

wherein, $T_1$ is a total area of peaks for the $C_7$-$C_{21}$ alkyl group, $C_7$-$C_{21}$ alkenyl group and $C_7$-$C_{21}$ alkynyl group in the $R_1$ and $R_2$ above, detected by HPLC (high pressure liquid chromatography), $Q_1$ is a total area of peaks for the saturated hydrocarbons, that is the $C_7$-$C_{21}$ alkyl group in the $R_1$ and $R_2$ above, detected by HPLC, $T_2$ is a total area of peaks for the $C_7$-$C_{21}$ alkyl group, $C_7$-$C_{21}$ alkenyl group and $C_7$-$C_{21}$ alkynyl group in the $R_5$ and $R_6$ above, detected by GC (gas chromatography), $Q_2$ is a total area of peaks for the saturated hydrocarbons, that is the $C_7$-$C_{21}$ alkyl group in the $R_5$ and $R_6$ above, detected by GC, $T_3$ is a total area of peaks for the $C_7$-$C_{21}$ alkyl group, $C_7$-$C_{21}$ alkenyl group and $C_7$-$C_{21}$ alkynyl group in the $R_7$, A and B above, detected by GC, $Q_3$ is a total area of peaks for the saturated hydrocarbons, that is $C_7$-$C_{21}$ alkyl group in the $R_7$, A and B above, detected by GC, X is a weight ratio of the compound represented by Formula 1 to the use amount of all cationic surfactants, Y is a weight ratio of the compound represented by Formula 2 to the use amount of all cationic surfactants, Z is a weight ratio of the compound represented by Formula 3 to the use amount of all cationic surfactants.

In addition, it is preferred that the cationic surfactant according to the present invention further complies with Mathematical Formula 4 below.

$$(P_1/T_1)*X+(P_2/T_2)*Y+(P_3/T_3)*Z \geqq 0.9 \quad \text{Mathematical Formula 4}$$

wherein, $P_1$ is a total area of peaks for the $C_{12}$-$C_{18}$ alkyl group, $C_{12}$-$C_{18}$ alkenyl group and $C_{12}$-$C_{18}$ alkynyl group in the $R_1$ and $R_2$ above, detected by HPLC (high pressure liquid chromatography), $P_2$ is a total area of peaks for the $C_{12}$-$C_{18}$ alkyl group, $C_{12}$-$C_{18}$ alkenyl group and $C_{12}$-$C_{18}$ alkynyl group in the $R_5$ and $R_6$ above, detected by GC (gas chromatography), $P_3$ is a total area of peaks for the $C_{12}$-$C_{18}$ alkyl group, $C_{12}$-$C_{18}$ alkenyl group and $C_{12}$-$C_{18}$ alkynyl group in the $R_7$, A and B above, detected by GC (gas chromatography), $T_1$, $T_2$, $T_3$, X, Y, and Z each are the same as defined above.

Said cationic surfactant is preferably included in an amount of 10 to 80 parts by weight relative to 100 parts by weight of all the composition. If the amount is less than 10 parts by weight, softening effect may be outstandingly lowered. If the amount is in excess of 80 parts by weight, it is difficult to prepare a sheet phase.

In addition, it is preferred that the present composition for textile softener further comprises an emulsifier. More preferably, the emulsifier includes an emulsifier having a hydrophilic-lipophilic balance (referred to 'HLB,' below) of 8 to 12, in view of easiness of preparing a sheet and an aspect that all the effective ingredients impregnated into the prepared sheet are dissolved or dispersed in washing water on washing.

The emulsifier is preferably included in an amount of 3 to 10 parts by weight relative to 100 parts by weight of all the composition. If the amount is less than 3 parts by weight, dispersibility of effective ingredients in washing water after preparing a sheet may be lowered. If the amount is in excess of 10 parts by weight, the slipping phenomenon is severe after preparing a sheet to have inconvenient use.

Preferably, the emulsifier used herein includes one or two or more selected from the group consisting of polyoxyethylene stearic ester, polyoxyethylene oleic ester, polyoxyethylene coconut ester, polyoxyethylene cetyl stearyl ether, polyoxyethylene stearyl ether, polyoxyethylene cetyl ether, polyoxyethylene oleyl ether, polyoxyethylene lauryl ether, polyoxyethylene octylphenyl ether, polyoxyethylene nonylphenylether, ethyoxylated caster oil, ethyoxylated caster wax, polyoxyethylene sorbitan ester, sorbitan fatty acid ester, polyoxyethylene lauryl amine, polyoxyethylene tallow amine, polyoxyethylene stearyl amine, polyoxyethylenemethyl ether, polyoxyethylene butyl ether, polyoxyethylene octyl ether, polyoxyethylene tridecyl ether, polyethylene glycol, polypropylene glycol, polyoxyethylene oxypropylene glycol, polyethyleneglycol fatty acid ester, ethyleneglycol fatty acid ester, alkylester, polyoxyalkylene alkyl ether, polyoxyalkylene alkyl aryl ether, polyoxyalkylene alkylester, polyoxyalkylene alkylaryl ether, polyoxyalkylene alkylaryl ester, polyoxyalkylene arylether, polyoxyalkylene derivatives, polyoxyalkylene polyol, polyethylene glycol monolaurate, polyethylene glycol dilaurate, polyethylene glycolmonostearate, polyethylene glycol distearate, polyethylene glycol monooleate, polyethylene glycol dioleate, methyllaurate, methyl myristate, methyl palmitate, methyl oleate, methylstearate, n-butyl oleate, n-butyl stearate, isobutyl stearate, isobutyl oleate, isooctyl oleate, isooctyl stearate, isooctyl palmitate, trimethylpropane oleate, di-oleyl adipate, sodium diisooctylsulfosuccinate, disodiumlaurylsulfosuccinate, sodium isethionate, sodium cocoylisethionate, dimethyl alkyl betaine, amine oxide, alkanol amide, acetylated glycol stearate, stearyl metharylate copolymer, vinyl isodecanoate cross polymer, allyl metharylate cross polymer, almond oil PEG-6 ester, almond oil PEG-8 ester, aluminum behenate, aluminum dicetyl phosphate, aluminum dilinoleate, aluminum dimyristate, aluminum isostearate, aluminum myristate, aluminum stearate, aluminum tristearate, ammonium cocosulfate, ammonium phosphatidyl rapeseedate, ammonium polyacrylate, ammonium polyacryloxydimethyl taurate, ammonium styrene, apricot kernel oil PEG-6/8/40 ester, arachidyl alcohol, argan oil PEG-8 ester, argan oil polyceryl-6 ester, avocado oil PEG-8/11 ester, avocado oil propylene glycol ester, babassuamidopropyltrimonium chloride, babassuamidopropyltrimonium methosulfate, beeswax, wax acid, beheneth-20, behenoyl stearic acid, behenyl alcohol, betonite, benzenesulfonyltromethamide, bis-PEG/PPG-14/14 dimethicone, bis-PEG/PPG-20/20 dimethicone, bis (PPG-7 undeceneth-21) dimethicone, butyldecylester(butyl decyl ester), butyleneglycol behenate, butylene glycol cocoate, butylene glycol isostearate, butylene glycol laurate, butylene glycol myristate, butylene glycol oleate, butylene glycol palmitate, butylene glycol stearate, butylglycoside caprate, butylglycoside hydroxypropyltrimonium chloride, butyloctanoic acid, C18-36 acid glycol ester, C12-20 acid PEG8 ester, calcium carboxymethyl cellulose, calcium carageenan, calcium laurate, calcium myristate, calcium potassium carbomer, calcium starch octenylsuccinate, calcium stearate, C9-11 alcohol, C12-13 alcohol, C12-15 alcohol, C12-16 alcohol, C12-15 alcohol, C12-22 alcohol, C20-22 alcohol, C20-40 alcohol, C30-50 alcohol, C10-16 alkyl glucoside, C12-20 alkyl glucoside, C18-38 alkyl hydroxystearoyl stearate, C9-15 alkyl phosphate, C20-22 alkyl phosphate, canola oil glyceride, capryleth-4/5, caprylic/capric triglyceride PEG-4 ester, caprylyl dimethicone ethoxy glycoside, carbomer, carboxymethyl cellulose acetate butyrate, carboxymethylhydroxyethyl cellulose, ceteareth-2/3/4/5/6/7/8/9/10/11/12/13/14/15/16/17/18/20/22, ceteareth-6 olivate, stearyl alcohol, cetearylglucoside, cetearyl wheat bran glycoside, cetearyl wheat straw glycoside, ceteth-1/2/3/4/5/6/7/8/10/12/13/14/15/16/17/18, cetereth-2/4/5/6/10/11/15, cetrimonium bromide, cetrimonium chloride, cetrimonium methosulfate, cetyl alcohol, cetyl hydroxyethyl cellulose, cetyl peg/ppg-7/3 dimethicone, cetyl phosphate, C15-18 glycol, C18-30 glycol, coleth-5/10/15/20/24/30, coceth-3/5/6/7/8/10/20/25, coconut oil PEG-10 ester, cocoyl ethyl glucoside, DEA cetyl sulfate, dextrin behenate, dextrin laurate, dextrin myristate, dextrin palmitate, dextrin stearate, alkoxylated alcohol, dicetearetn-10 phosphate, dicetyl phosphate, diethylaminoethylcocoate, diethylaminoethylstearate, diisocetyl dodecanedioate, dimethyl capramide, dimethyl octynediol, dioleyl phosphate, disodium cetearyl sulfosuccinate, disodium coco-glucoside citrate, disodium lauryl phosphate, disodium PEG-8 lysinosuccinate, distearamidopropylmethylamine, dodecylhexadecanol, glucose pentaacetate, glyceryl arachidate, glyceryl behenate, glyceryl carpate, glyceryl carylate, glyceryl cocoate, glyceryl erucate, glyceryl isostearate, glyceryl isostearate/myristate, glyceryl isostearate, glyceryl lanolate, glyceryl laurate, glyceryl laurate/oleate, glyceryl laurate, glyceryl lauryl ether, glyceryl linoleate, glyceryl linolenate, glyceryl montanate, glyceryl myristate, glyceryl oleate, glyceryl oleate citrate, glyceryl oleate/elaidate, glyceryl palmitate, glyceryl pentadecanoate, glyceryl ricinolate, glyceryl rosinate, glyceryl stearate, glyceryl stearate citrate, glyceryl tallowate, glyceryl undecyleneate, glycol hydroxystearate, glycol montanate, glycol oleate, glycol palmitate, glycol ricinoleate, glycol stearate, glycol tallate, hexadecyleicosanoic acid, hydroxyethyl ethylcellulose, hydroxypropyl cellulose, hydroxypropyl methylcellulose, hydroxypropyl xanthan gum, lauryl alcohol, lauryl laurate, lauryl phosphate, lecithin, methyl cellulose, oleyl ethyl phosphate, oleyl phosphate, palm acid, palm alcohol, palm glycoside palmitic acid, palm kernel alcohol, alkoxylated carboxylic acid, alkoxylated amine, alkoxylated amide, sorbitan derivatives, polypropylene terephthalate, potassium dextrin octenylsuccinate, sodium beeswax, sodium behenoyl lactylate, sodium caproyl lactylate, sodium carpylate, sodium cellulose sulfate, sodium cetyl sulfate, alkylamido alkylamine, sodium linoleate, sodium stearyl phthalamate, sodium stearyl sulfate, stearyl alcohol, sucrose cocoate, sucrose dilaurate, sucrose distearate, sucrose hexaerucate, sucrose laurate, sucrose myristate, sucrose oleate, sucrose palmitate, and tallow glyceride.

In addition, it is preferred that the present composition for textile softener further comprises a perfume, a preservative, a stabilizer, a pigment or an antibacterial agent.

The perfume used herein may use a perfume which is usually used in the detergent field such as textile softener, laundry detergent and the like. Preferred stabilizer is a heat resistant or light resistant stabilizer. Such a stabilizer may be easily selected and used by those having ordinary knowledge in this field.

In addition, the pigment may use a pigment which is usually used in the detergent field such as textile softener, laundry detergent and the like. However, it is preferred to use one damages in colors of clothes are not induced. The antibacterial agent may use a preservative or a cationic antibacterial agent which is used in this field.

The present invention also relates to a sheet for textile softener comprising a substrate sheet; and a composition for textile softener according to the present invention.

The present sheet for textile softener may be used by introducing it at a rinse time during washing procedures of clothes that is the same method as that of a liquid typed textile softner, and has easiness of use which is an advantage of sheet typed textile softener used for dryers.

It is preferred that the present sheet for textile softener is prepared by applying or supporting a composition for textile softener according to the present invention as an effective ingredient on a substrate sheet and cutting it into a suitable size.

Said substrate sheet is preferably a non-woven fabric comprising one or more polymers selected from the group consisting of polyethyleneterephthalate (PEF, below), polypropylene (PP, below), and polyethylene (PE, below).

A method for applying or supporting said composition for textile softener on a substrate sheet is not specifically limited, and may use those to be usually utilized. A total amount of textile softener and a size of substrate sheet are also not specifically limited, and may be appropriately selected, considering effective amount of textile softener usually required for washing water and absorbability of liquid ingredients in the sheet.

The present sheet for textile softener prepared above represents textile softening and anti-static effects in clothes by dissolving or dispersing all effective ingredients supported in the sheet even in water at low temperature, usually 0° C. to 25° C., in a rise time during washing procedures.

The composition for textile softener according to the present invention is easily applied or supported on a sheet, and has excellent solubility that all the composition are dissolved or dispersed even in low temperature water. In addition, the sheet for textile softener comprising said composition for textile softener is introduced in as much as a needed amount together with the laundry, at a rinse time of general washing machine to provide fabrics and clothes with excellent softening effect, anti-static effect and a sense of residual perfume, and has easiness of use which is an advantage of sheet typed textile softener used for dryers.

The present invention is more specifically explained through Examples and Comparative Examples below. However, the examples are provided to illustrate the present invention, the present invention is not restricted to them only.

<Analysis of Substituents in Cationic Surfactant>

Analysis of Substituents in Ester Quat

Ratios of long chain substituents ($C_{12}$-$C_{18}$ alkyl group, $C_{12}$-$C_{18}$ alkyl group, $C_{12}$-$C_{18}$ alkyl group) and saturated hydrocarbon ($C_7$-$C_{21}$ alkyl group) in ester quat were measured by subjecting a specimen with removed water to methylation at 80° C. for 3 hours, and then extracting the reacted component with hexane to perform GC analysis.

Analysis of Substituents in Imidazole

Ratios of long chain substituents ($C_{12}$-$C_{18}$ alkyl group, $C_{12}$-$C_{18}$ alkyl group, $C_{12}$-$C_{18}$ alkyl group) and saturated hydrocarbon ($C_7$-$C_{21}$ alkyl group) in imidazole were measured by adding a specimen to dioxane and potassium hydroxide to react the mixture at 105° C. for 2 hours, adding the resulting product to HCl solution to further react the mixture at 105° C. for 4 hours, extracting the resulting product with ether, subjecting the product with removed water to methylation at 80° C. for 3 hours, and then extracting the reacted component with hexane to perform GC analysis.

Analysis of Substituents in DDAC

A specimen was sufficiently dissolved in IPA, the solution was filtered through 0.45 μm disk filter, and ratios of long chain substituents ($C_{12}$-$C_{18}$ alkyl group, $C_{12}$-$C_{18}$ alkyl group, $C_{12}$-$C_{18}$ alkyl group) and saturated hydrocarbon ($C_7$-$C_{21}$ alkyl group) in DDAC were measured by using HPLC.

EXAMPLES 1 TO 3

Compositions for textile softener to be applied on sheets in Examples 1 to 3 were prepared using ingredients and composition ratios represented in Table 1 below, in accordance with usual methods, and these were impregnated into non-woven fabrics to prepare sheets for textile softener. Cationic surfactants of Formulas 1 to 3 below that ratios of long chain substituents ($C_{12}$-$C_{18}$ alkyl group, $C_{12}$-$C_{18}$ alkyl group, $C_{12}$-$C_{18}$ alkyl group) are 0.92, 0.94 and 0.95, respectively, and ratios of saturated hydrocarbon ($C_7$-$C_{21}$ alkyl group) are 0.88, 0.62, and 0.66, respectively were used.

TABLE 1

| Ingredients | | Example 1 | 2 | 3 |
|---|---|---|---|---|
| CationicSurfactant | DDAC (Formula 1) | 50 | | |
| | EQ (Formula 2) | | 50 | |
| | Imidazoline (Formula 3) | | | 50 |
| Emulsifier | Polyoxyethylene sorbitan ester TW-81 (HLB 10) | 3 | 3 | 3 |
| Others | Perfume, stabilizer, etc. | slight | slight | slight |

DDAC: Dimethyl dialkyl ammonium chloride EQ: Ester Quat
(Unit: part by weight)

EXAMPLES 4 TO 6

Compositions for textile softener in Examples 4, 5 and 6 were each prepared in ratios and manners same as those of Examples 1, 2 and 3, provided that oleyl ether OA-20 (HLB 15.4) as an emulsifier was used in the same amount.

EXAMPLES 7 TO 9

Compositions for textile softener in Examples 7, 8 and 9 were each prepared in ratios and manners same as those of Examples 1, 2 and 3, provided that octylphenyl ether OP-5 (HLB 10.3) as an emulsifier was used in the same amount.

EXAMPLES 10 TO 12

Compositions for textile softener in Examples 10, 11 and 12 were each prepared in ratios and manners same as those of Examples 1, 2 and 3, provided that lauryl ether LA-6 (HLB 11.5) as an emulsifier was used in the same amount.

EXAMPLES 13 TO 15

Compositions for textile softener in Examples 13, 14 and 15 were each prepared in ratios and manners same as those of Examples 1, 2 and 3, provided that cetyl ether CA-7 (HLB 11.2) as an emulsifier was used in the same amount.

EXAMPLES 16 TO 18

Compositions for textile softener in Examples 16, 17 and 18 were each prepared in ratios and manners same as those of Examples 1, 2 and 3, provided that stearyl ether SA-7 (HLB 10.7) as an emulsifier was used in the same amount.

EXAMPLES 19 TO 21

Compositions for textile softener in Examples 19, 20 and 21 were each prepared in ratios and manners same as those of Examples 1, 2 and 3, provided that coconut ester FA-07C (HLB 12.1) as an emulsifier was used in the same amount.

EXAMPLES 22 TO 24

Compositions for textile softener in Examples 22, 23 and 24 were each prepared in ratios and manners same as those of Examples 1, 2 and 3, provided that stearyl amine SM-5 (HLB 9) as an emulsifier was used in the same amount.

EXAMPLES 25 TO 27

Compositions for textile softener in Examples 25, 26 and 27 were each prepared in ratios and manners same as those of Examples 1, 2 and 3, provided that polyethylene glycol PEG-200 (HLB 9.3) as an emulsifier was used in the same amount.

EXAMPLES 28 TO 30

Compositions for textile softener in Examples 28, 29 and 30 were each prepared in ratios and manners same as those of Examples 1, 2 and 3, provided that polyoxyethylene nonylphenyl ether NP-60 (HLB 18.5) as emulsifier was used in the same amount.

COMPARATIVE EXAMPLES 1 TO 4

Compositions for textile softener in Comparative Examples 1 to 4 were prepared using ingredients and composition ratios represented in Table 2 below, in accordance with usual methods, and these were applied on sheets to prepare sheets for textile softener. DDAC in Comparative Example 1 that the ratio of long chain substituents ($C_{12}$-$C_{18}$ alkyl group, $C_{12}$-$C_{18}$ alkyl group, $C_{12}$-$C_{18}$ alkyl group) is 0.5, and the ratio of saturated hydrocarbon ($C_7$-$C_{21}$ alkyl group) is 0.56 was used. DDAC in Comparative Example 2 that the ratio of long chain substituents is 0.4, and the ratio of saturated hydrocarbon is 0.5 was used. EQ in Comparative Example 3 that the ratio of long chain substituents is 0.4, and the ratio of saturated hydrocarbon is 0.5 was used. Imidazoline in Comparative Example 4 that the ratio of long chain substituents is 0.4, and the ratio of saturated hydrocarbon is 0.5 was used.

TABLE 2

| Ingredients | | Comparative Example 1 | 2 | 3 | 4 |
|---|---|---|---|---|---|
| Quaternaryammonium | DDAC | 50 | | | |
| | DDAC | | 50 | | |
| | EQ | | | 50 | |
| | Imidazoline | | | | 50 |
| Emulsifier | Polyoxyethylene sorbitan ester TW-81 (HLB 10) | 3 | 3 | 3 | 3 |
| Others | Perfume, Stabilizer | Slight | slight | slight | slight |

(Unit: part by weight)

EXPERIMENTAL EXAMPLE 1

Test of Softening Effect

100% Cotton towels were repeatedly washed 5 times using a standard amount of general washing detergent by a washing machine and spin-dried. Then, they were subjected to softening in each rinse water (bath ratio 1:30, 25° C.) using each one sheet for textile softener in Examples and Comparative Examples above, spin-dried, and subjected to conditioning under a condition of 20° C. and 65% RH for 24 hours. Then, a degree of touch was given to them in at least 1 to 5 points as a softening point with organoleptic assessment tests by skilled panelists. The above procedure was repeated by 3 times or more. Softening effect was measured as the average value of softening points.

TABLE 3

| Assessment Results | very good (◎) | Good (○) | mild (Δ) | poor (X) |
|---|---|---|---|---|
| Point of Softening effect | more than 4.5 | 3.5~4.5 | 2.5~3.5 | less than 2.5 |

EXPERIMENTAL EXAMPLE 2

Absorbability Test

Standard cottons were classified to weft and warp and cut in a size of 2 15 cm. They were subjected to softening by the same method as in Experimental Example 1 and subjected to conditioning under a condition of 20° C. and 65% RH for 24 hours. Then, specimen fabrics were vertically hung using clamps and poises and ends of specimen pieces were simultaneously dipped in a solution of an aqueous blue dye diluted to 0.1% in water. After 20 minutes, height of blue dye from bottom was measured. This procedure was repeated by 3 times or more. Absorbability effect was tested as their average value.

TABLE 4

| Assessment Result | Very good (◎) | good (○) | mild (Δ) | Poor (X) |
|---|---|---|---|---|
| Absorbing height (mm) | more than 100 | 70~100 | 40~70 | less than 40 |

EXPERIMENTAL EXAMPLE 3

Antistatic Test (Friction-Charged Electrostatic Potential

White cottons, white polyester fabrics, nylon fabrics (manufactured by Korea Apparel Testing & Research Institute) for testing color fastness on KS K-0950 were each cut in a size of 4 6 cm. They were subjected to softening by the same method as in Experimental Example 1 and subjected to conditioning under a condition of 20° C. and 65% RH for 24 hours. Then, specimen fabrics were subjected to rolling friction at 600 RPM for 60 seconds with a testing method of KS K-0555B, using Rotary Static Tester Apparatus manufactured by DAIEI KAGAKU SEIKI MFG. CO., LTD (Japan) to measure the resulting charged electrostatic potential. This experiment was repeated by 3 times or more to measure anti-static property.

EXPERIMENTAL EXAMPLE 4

Anti-Static Test (Half Life)

Fabrics were subjected to softening by the same method as in Experimental Example 3 and subjected to conditioning under a condition of 20° C. and 65% RH for 24 hours. Then, leakage rates were measured, as a time of dropping to half voltage after applying an initial voltage of 150 V, by applying a testing method of KS K-0555A and using Static Voltmeter Apparatus manufactured by Rothschild-Instruments (Swiss). This procedure was repeated by 3 times or more to evaluate the property.

TABLE 5

| Assessment Result | very good (◎) | good (○) | mild (Δ) | poor (X) |
|---|---|---|---|---|
| Leakage rate (sec) | not more than 10 | 10~10 | 10~10 | more than 10 |

EXPERIMENTAL EXAMPLE 5

Solubility Test

For measuring whether how much effective ingredients in sheets for textile softener were well dissolved at low temperature and dispersed in washing water on rinsing after washing, 31 of 20° C. low temperature water was added to a 31 beaker and products of Examples and Comparative Examples each added thereto. The mixture was stirred for 5 minutes. Solubility, the amount of which effective ingredients was dissolved, was measured by measuring the weight of initial products and the weight of dried products after treating. The above procedure was repeated by 3 times or more to measure the solubility.

TABLE 6

| Assessment Result | very good (◎) | good (○) | mild (Δ) | poor (X) |
|---|---|---|---|---|
| Dissolving amount | more than 90% | 80~0% | 70~80% | not more than 70% |

The results of performance assessment for Examples and Comparative Examples represent in Table 7 below.

TABLE 7

Results of Performance Assessment

| Test | | Example 1~3 | Example 4~12 | Comparative Example 1~2 | Comparative Example 3 | Comparative Example 4 |
|---|---|---|---|---|---|---|
| Softening effect | | ◎ | ◎ | ○ | Δ | Δ |
| Solubility/Dissolving Property | | ◎ | ◎ | X | X | X |
| Absorbability | | ◎ | ◎ | Δ | Δ | Δ |
| Anti-staticProperty | Friction-charged electrostatic potential | ◎ | ◎ | Δ | Δ | Δ |
| | Half life | ◎ | ◎ | Δ | Δ | Δ |

It can be known from the results of Table 7 above that sheets for textile softener in Examples 1 to 12 have excellent softening property, solubility, dissolving property, absorbability, anti-static property over sheets for textile softener in Comparative Examples 1 to 4.

INDUSTRIAL APPLICABILITY

The present composition for textile softener is easily applied or supported on the sheet, and has excellent solubility that all ingredients are dissolved or dispersed even in low temperature water. In addition, the sheet for textile softener comprising said composition for textile softener may be used for representing excellent anti-static effect and fabric softening effect to textiles and clothes by introducing it at a rinse time during washing procedures in as much as a needed amount together with the laundry.

What is claimed is:

1. A softening method of textile using a sheet for textile softener comprising introducing the sheet for textile softener at a rinse time of washing procedures;

wherein the sheet for textile softener comprising a substrate sheet; and a composition for textile softener, applied or supported on the substrate sheet, wherein the composition being dispersed in low temperature water and comprising one or more cationic surfactants represented by Formula 1, 2 or 3 below, wherein the cationic surfactant complies with Mathematical Formula 1 below:

Formula 1

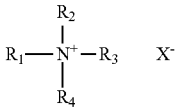

Formula 2

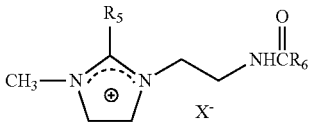

Formula 3

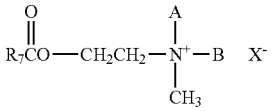

$$0.6 \leqq Q/T \leqq 0.9$$ Mathematical Formula 1 wherein, $R_1$, $R_2$, $R_5$, $R_6$ and $R_7$ each are a straight or branched, $C_7$-$C_{21}$ alkyl group, $C_7$-$C_{21}$ alkenyl group or $C_7$-$C_{21}$ alkynyl group, $R_3$ and $R_4$ each are a $C_1$-$C_4$ alkyl group, A is a $C_1$-$C_4$ alkyl group, $(CH_2)_nOH$ or $(CH_2)_mOCOR_8$, B is $(CH_2)_nOH$ or $(CH_2)_mOCOR_9$, where, n and m each are an integer of 1 to 4, $R_8$ and $R_9$ each are a straight or branched, $C_7$-$C_{21}$ alkyl group, $C_7$-$C_{21}$ alkenyl group or $C_7$-$C_{21}$ alkynyl group, X is halogen or a $C_1$-$C_4$ alkyl sulfate, T is a total area of peaks for the $C_7$-$C_{21}$ alkyl group, $C_7$-$C_{21}$ alkenyl group and $C_7$-$C_{21}$ alkynyl group in the $R_1$, $R_2$, $R_5$, $R_6$, $R_7$, A and B above, detected by high pressure liquid chromatography or gas chromatography, and Q is a total area of peaks for the saturated hydrocarbons, that is the $C_7$-$C_{21}$ alkyl group in the $R_1$, $R_2$, $R_5$, $R_6$, $R_7$, A and B above, detected by high pressure liquid chromatography or gas chromatography.

2. The softening method of claim 1, wherein the cationic surfactant further complies with Mathematical Formula 2 below:

$$0.9 \leqq P/T$$ Mathematical Formula 2 wherein,

P is a total area of peaks for the $C_{12}$-$C_{18}$ alkyl group, $C_{12}$-$C_{18}$ alkenyl group and $C_{12}$-$C_{18}$ alkynyl group in the $R_1$, $R_2$, $R_5$, $R_6$, $R_7$, A and B above, detected by high pressure liquid chromatography or gas chromatography, and T is as defined in claim 1.

3. The softening method of claim 2, wherein the cationic surfactant further complies with Mathematical Formula 4 below:

$$(P_1/T_1)*X+(P_2/T_2)*Y+(P_3/T_3)*Z>0.9$$ Mathematical Formula 4 wherein, $P_1$ is a total area of peaks for the $C_{12}$-$C_{18}$ alkyl group, $C_{12}$-$C_{18}$ alkenyl group and $C_{12}$-$C_{18}$ alkynyl group in the $R_1$ and $R_2$ above, detected by high pressure liquid chromatography, $P_2$ is a total area of peaks for the $C_{12}$-$C_{18}$ alkyl group, $C_{12}$-$C_{18}$ alkenyl group and $C_{12}$-$C_{18}$ alkynyl group in the $R_5$ and $R_6$ above, detected by gas chromatography, $P_3$ is a total area of peaks for the $C_{12}$-$C_{18}$ alkyl group, $C_{12}$-$C_{18}$ alkenyl group and $C_{12}$-$C_{18}$ alkynyl group in the $R_7$, A and B above, detected by gas chromatography, $T_1$ is a total area of peaks for the $C_7$-$C_{21}$ alkyl group, $C_7$-$C_{21}$ alkenyl group and $C_7$-$C_{21}$ alkynyl group in the $R_1$ and $R_2$ above, detected by high pressure liquid chromatography, $T_2$ is a total area of peaks for the $C_7$-$C_{21}$ alkyl group, $C_7$-$C_{21}$ alkenyl group and $C_7$-$C_{21}$ alkynyl group in the $R_5$ and $R_6$ above, detected by gas chromatography, $T_3$ is a total area of peaks for the $C_7$-$C_{21}$ alkyl group, $C_7$-$C_{21}$ alkenyl group and $C_7$-$C_{21}$ alkynyl group in the $R_7$, A and B above, detected by gas chromatography, X is a weight ratio of the compound represented by Formula 1 to the use amount of all cationic surfactants, Y is a weight ratio of the compound represented by Formula 2 to the use amount of all cationic surfactants, and Z is a weight ratio of the compound represented by Formula 3 to the use amount of all cationic surfactants.

4. The softening method of claim 1, wherein the cationic surfactant further complies with Mathematical Formula 3 below:

$$0.6 \leqq (Q_1/T_1)*X+(Q_2/T_2)*Y+(Q_3/T_3)*Z<0.9$$ Mathematical Formula 3 wherein, $T_1$ is a total area of peaks for the $C_7$-$C_{21}$ alkyl group, $C_7$-$C_{21}$ alkenyl group and $C_7$-$C_{21}$ alkynyl group in the $R_1$ and $R_2$ above, detected by high pressure liquid chromatography, $Q_1$ is a total area of peaks for the saturated hydrocarbons, that is the $C_7$-$C_{21}$ alkyl group in the $R_1$ and $R_2$ above, detected by high pressure liquid chromatography, $T_2$ is a total area of peaks for the $C_7$-$C_{21}$ alkyl group, $C_7$-$C_{21}$ alkenyl group and $C_7$-$C_{21}$ alkynyl group in the $R_5$ and $R_6$ above, detected by gas chromatography, $Q_2$ is a total area of peaks for the saturated hydrocarbons, that is the $C_7$-$C_{21}$ alkyl group in the $R_5$ and $R_6$ above, detected by gas chromatography, $T_3$ is a total area of peaks for the $C_7$-$C_{21}$ alkyl group, $C_7$-$C_{21}$ alkenyl group and $C_7$-$C_{21}$ alkynyl group in the $R_7$, A and B above, detected by gas chromatography, $Q_3$ is a total area of peaks for the saturated hydrocarbons, that is $C_7$-$C_{21}$ alkyl group in the $R_7$, A and B above, detected by gas chromatography, X is a weight ratio of the compound represented by Formula 1 to the use amount of all cationic surfactants, Y is a weight ratio of the compound represented by Formula 2 to the use amount of all cationic surfactants, and Z is a weight ratio of the compound represented by Formula 3 to the use amount of all cationic surfactants.

5. The softening method of claim 1, wherein the amount of cationic surfactant is 10 to 80 parts by weight relative to 100 parts by weight of all the composition.

6. The softening method of claim 1, wherein the composition further comprises an emulsifier.

7. The softening method of claim 6, wherein the amount of emulsifier is 3 to 10 parts by weight relative to 100 parts by weight of all the composition.

8. The softening method of claim 1, wherein the composition further comprises a perfume, a preservative, a stabilizer, a pigment or an antibacterial agent.

* * * * *